US007214033B2

(12) United States Patent
Lee et al.

(10) Patent No.: US 7,214,033 B2
(45) Date of Patent: May 8, 2007

(54) BLOWER FAN

(75) Inventors: Jung Woo Lee, Seoul (KR); Moon Kee Chung, Seoul (KR); Sim Won Chin, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 10/943,007

(22) Filed: Sep. 17, 2004

(65) Prior Publication Data

US 2005/0196282 A1 Sep. 8, 2005

(30) Foreign Application Priority Data

Mar. 5, 2004 (KR) ..... 10-2004-0015170

(51) Int. Cl.
*F04D 29/30* (2006.01)

(52) U.S. Cl. ..... 416/186 R; 416/228

(58) Field of Classification Search ..... 416/186 R, 416/187–189, 228, 243
See application file for complete search history.

(56) References Cited

U.S. PATENT DOCUMENTS 3,224,079 A * 12/1965 Dybvig ..... 29/889.4
3,668,887 A * 6/1972 Riello ..... 62/262
4,211,514 A * 7/1980 Hawes ..... 415/191
4,647,271 A 3/1987 Nagai et al.
2002/0106277 A1* 8/2002 Chapman ..... 415/206
2002/0110455 A1 8/2002 Kim et al.

FOREIGN PATENT DOCUMENTS

| | | |
|---|---|---|
| DE | 19500994 | 7/1996 |
| GB | 1141198 | 1/1969 |
| JP | 14-022210 | 1/2002 |

OTHER PUBLICATIONS

English Language Abstract of JP 14-022210.
English Language Abstract of DE 19500994.
U.S. Appl. No. 10/943,102 to Lee et al.

* cited by examiner

*Primary Examiner*—Ninh H. Nguyen
(74) *Attorney, Agent, or Firm*—Greenblum & Bernstein, P.L.C.

(57) ABSTRACT

A blower fan includes a shroud, a hub for guiding airflow being discharged, and a plurality of blades disposed between the shroud and the hub. A first outer diameter of a first portion, which is close to the hub, of the blade is different from a second outer diameter of a second portion, which is close to the shroud, of the blade.

22 Claims, 4 Drawing Sheets

BLOWER FAN

BACKGROUND OF THE INVENTION

1. Field of the Invention

The present invention relates to a blower fan, and more particularly, to a blower fan that is designed to improve the blowing efficiency by reducing airflow loss and reduce the noise generated when blades rotate.

2. Description of the Related Art

Generally, a blower fan is a device for forcedly producing air current. Particularly, a turbo fan that is one of the blower fans is designed to induce air in an axial direction, allow the induced air to make a turn by 90° and forcedly blow the same in a radial direction thereof.

The blower fan includes a shroud formed on an air inducing side, a hub formed on an air discharge side, and a plurality of blades fixed between the shroud and the hub. To improve the productivity of the blower fan in a molding process and increase an airflow rate, the blower fan is designed having an inner diameter less than an outer diameter of the hub. In addition, the blade is designed having an outer diameter greater than that of the hub. The hub formed on the air discharge side functions to guide airflow such that air can effectively discharged, changing its flow direction by the blades. For the production convenience, an outer end of the blade is formed perpendicular to the hub and shroud.

When the hub is designed having the outer diameter less than that of the blade, airflow of the air passing the blower fan cannot be sufficiently guided. That is, although the air current is forcedly formed by the blades, there may be a non-guide area where the airflow cannot be guided by the hub. Particularly, eddy current is increased in the non-guide area. This causes the noise to be increased. Furthermore, since the air guided and discharged by the hub conflicts with the air guided and discharged by the blades, intensive turbulence is created to further increase the noise.

In addition, the eddy current deteriorates the operating efficiency of the fan, thereby increasing the power consumption. The eddy current also causes the airflow loss. Therefore, when the fan is employed to an air conditioner, the eddy current causes the reduction in an amount of cool air. Therefore, to increase the amount of cool air, an RPM of the blower fan should be increased. This causes the increase of the power consumption.

SUMMARY OF THE INVENTION

Accordingly, the present invention is directed to a blower fan that substantially obviates one or more problems due to limitations and disadvantages of the related art.

An object of the present invention is to provide a blower fan that can reduce the turbulence and the noise, which may be created at an air discharge side, by optimizing the designs of blades and a hub.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a blower fan including: a shroud; a hub for guiding airflow being discharged; and a plurality of blades disposed between the shroud and the hub, wherein a first outer diameter of a first portion, which is close to the hub, of the blade is different from a second outer diameter of a second portion, which is close to the shroud, of the blade, for forcedly blowing an air through a rotation of the blades.

In an aspect of the present invention, there is provided a blower fan including: a shroud; a hub disposed facing the shroud at a predetermined distance from the shroud; and a plurality of blades disposed between the shroud and the hub, wherein, when a first outer diameter of a first portion, which is close to the hub, of the blade is D1, a second outer diameter of a second portion, which is close to the shroud, of the blade is D2, and an outer diameter of the hub is D0, $0.5<(D2-D1)/(D2-D0)<0.9$ is satisfied.

In another aspect of the present invention, there is provided a blower fan including: a shroud formed on an air intake side; a hub formed on an air discharge side to guide airflow being discharged; and a plurality of blades disposed between the shroud and the hub, wherein an outer end of each of the blades is inclined as it goes from a shroud side to a hub side, for reducing airflow noise.

It is to be understood that both the foregoing general description and the following detailed description of the present invention are exemplary and explanatory and are intended to provide further explanation of the invention as claimed.

According to the present invention, by the optimized design of the blades, eddy current that may be caused by the flow interference between the hub and the ends of the blades can be suppressed, while the airflow noise and the power consumption rate can be reduced.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
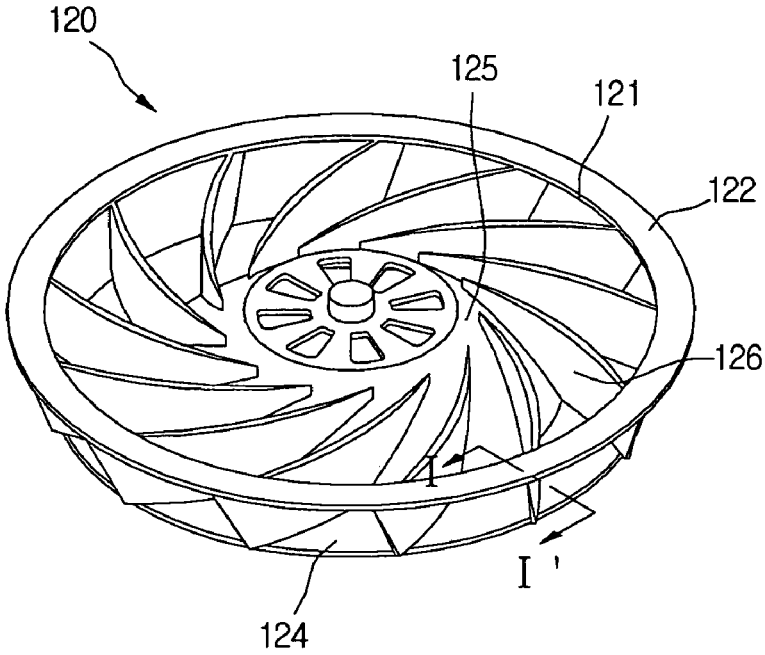
FIG. 1 is a perspective view of a blower fan according to an embodiment of the present invention.

FIG. 1 shows a blower fan according to an embodiment of the present invention.

The inventive blower fan includes a shroud 122 formed on an air intake side, a hub 124 formed on an air discharge side, and a plurality of blades 126 formed between the shroud 122 and the hub 124.

Formed on a front surface of the shroud 122 is a bell mouth 130 (see FIG. 6) for effectively guiding the airflow of intake air.

In this embodiment, although a turbo fan is exampled as the inventive blower fan, the concepts of the present invention are not limited to the turbo fan. The concepts of the present invention can be applied to a variety of other types of blower fan.

As a feature of the present invention, each of the blades 126 is designed such that an outer diameter of each blade 126 with respect to the rotation of the blades is gradually reduced as it goes from the shroud 122 to the hub 124. That is, the outer diameter of the blade 126, which is closer to the shroud 122, is greater than the outer diameter of the blade 126, which is closer to hub 124, whereby the interference and confliction between the air discharged from the blades 126 and the air discharged from the hub 124 can be reduced to thereby reduce airflow noise and turbulence.

Describing in more detail, the hub 124 is formed in a truncated-funnel shape and disposed facing the shroud 122. A central portion of the hub 124 is elevated toward the shroud 122 so as to reduce air resistance and convert the airflow direction into a circumferential direction of the fan. A motor (not shown) is installed on an inner-central portion of the hub 124. The hub 124 is provided at the central portion with a shaft insertion portion in which a rotational shaft (not shown) of the motor is inserted.

Upper and lower longitudinal sides of the blade 126 are gently curved. The upper longitudinal side, which is close to the shroud 122, extends up to an outer circumference of the shroud 122, being longer than the lower longitudinal side, which is close to the hub 124. A length of the lower longitudinal side of the blade 126 is preferably less than that of an outer diameter of the hub 124. That is, as described above, each of the blades 126 is designed such that the outer diameter of each blade 126 is gradually reduced as it goes from the shroud side to the hub side.

The operation of the above-described blower fan will be described hereinafter.

Figure 6:
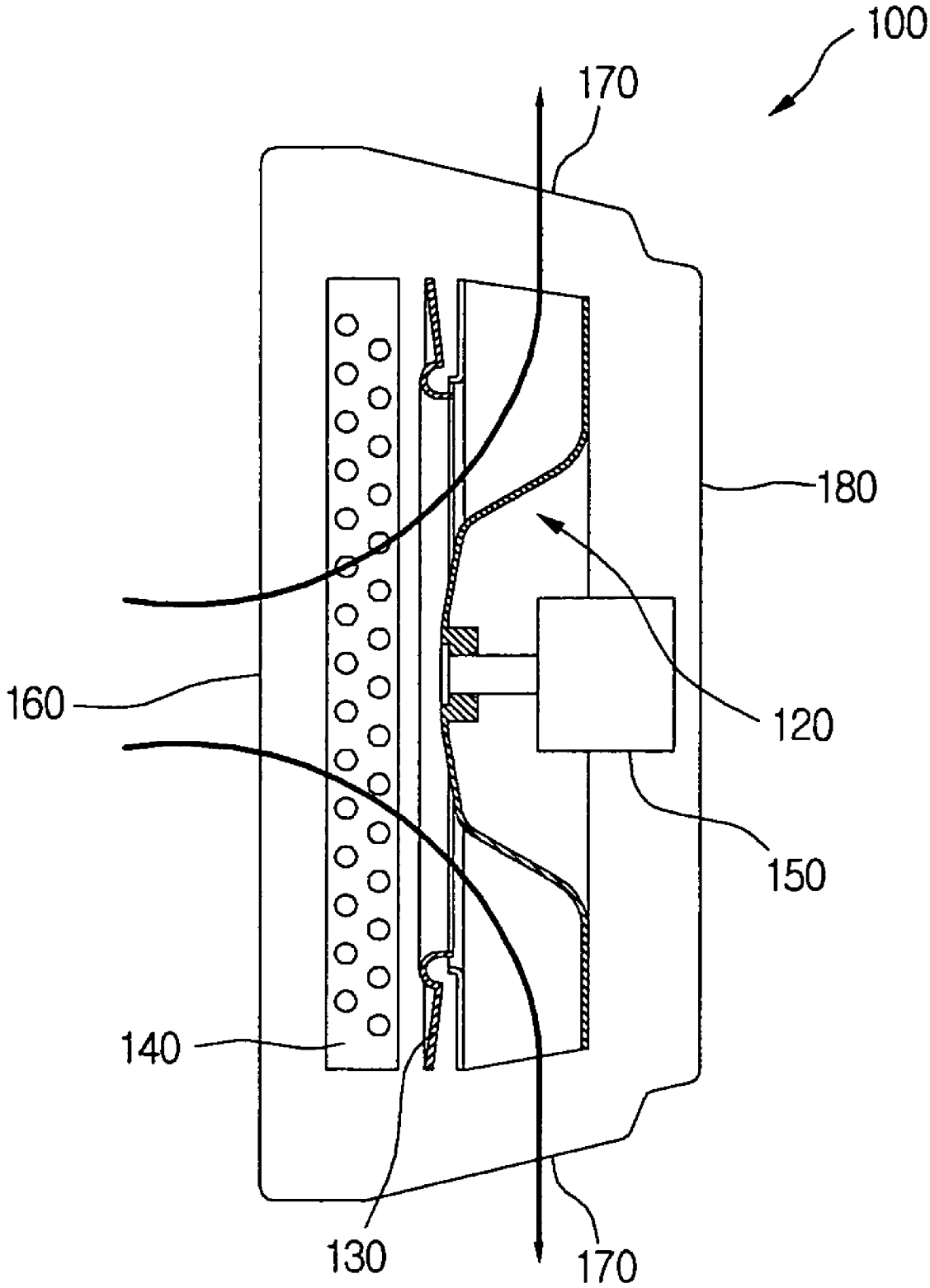
FIG. 6 is a sectional view of a wall mount air conditioner where a flower fan of the present invention is applied.

Referring to FIGS. 1 and 6, air is induced into the blower fan while being effectively guided by the bell mouth 130. The induced air changes its flow direction by 90° by the blades 126. The air is then discharged out of the fan while being guided by the hub 124 and the shroud 122. That is, the air is induced in a vertical direction of the blower fan and discharged in a central direction of the blower fan after being changed in its flow direction by 90°. Since the outer circumferential portion defined by the blades 126 is gradually inclined inward as it goes from an upper end to a lower end, i.e., from the shroud side to the hub side, a little interference between the air discharged from lower ends of the blades and the air discharged from the hub 124 is incurred.

At this point, the inclination of the circumferential portion may cause the reduction in a flow rate. Therefore, to compensate for this, the blades 126 are designed extending toward the central portion of the hub 124 as far as possible. That is, the hub 124 is provided at a central portion with an elevated portion 125 on which the motor is mounted. The blades 126 extend up to an outer circumference of the elevated portion. Preferably, a length of each blade 126 is greater than a half of a radius of the hub 124 to effectively compensate for a loss of the flow rate. In order to design the blades as described above, a width of the blade 126 is designed being gently reduced as it goes toward the central portion of the hub 124. An outer end of the blade is gently formed.

Figure 2:
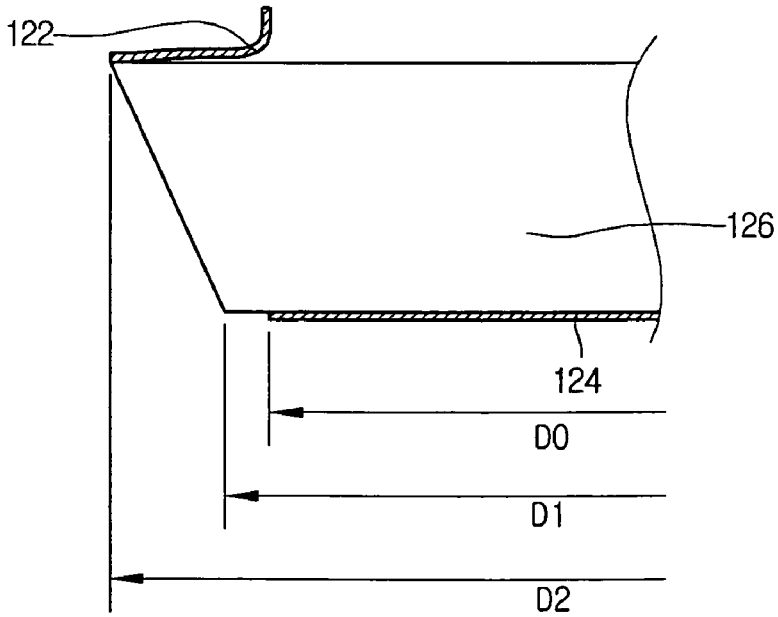
FIG. 2 is a sectional view taken along line I–I' of FIG. 1.

FIG. 2 shows a sectional view taken along line I–I' of FIG. 1.

Referring to FIG. 2, there are shown the shroud 122, the hub 124 and the blade 126.

An outer diameter of the blade 126 is varied as it goes from the shroud side to the hub side. That is, an outer diameter D1 of a portion of the blade 125, which is close to the hub 124, is less than that D2 of a portion of the blade 124, which is close to the shroud 122. At this point, the variation ratio (ΔD-ratio) of the outer diameter can be defined as Equation 1 below.

$$\Delta D\text{-ratio}=(D2-D1)/(D2-D0) \quad \text{(Equation 1)}$$

where, D0 is a diameter of the hub 124.

It is preferable that the variation ratio is in a range of 50–90%. The diameters D0, D1 and D2 are defined with reference to a center of the blower fan. The reason why the variation ratio is preferably set in the range of 50–90% is to reduce the airflow interference between ends of the hub 124 and the blade 126 as well as to reduce eddy current that may be generated at an end of the blade 126 proximal to the hub 124. As the generation of the eddy current is reduced, the noise can be alleviated.

Figure 3:
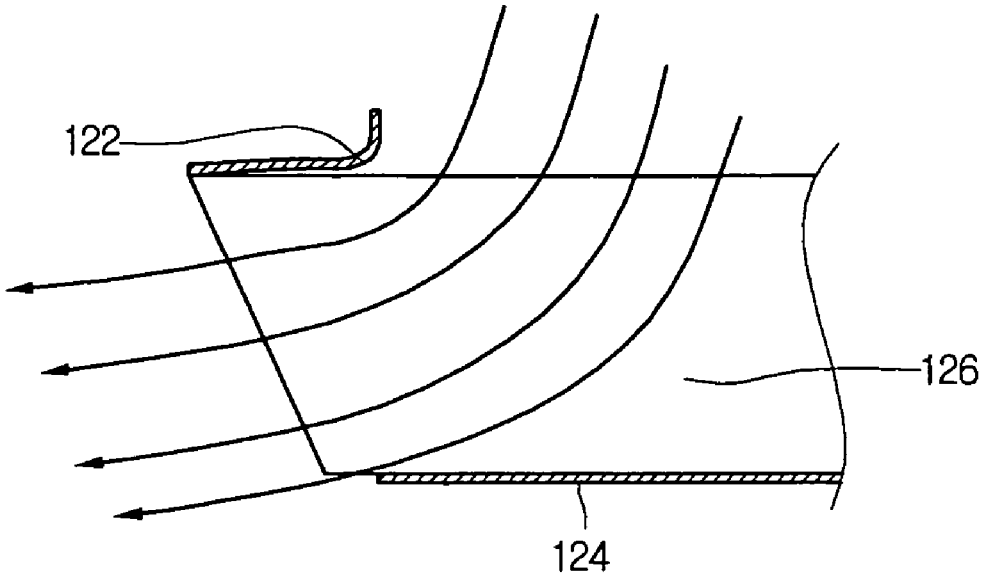
FIG. 3 is a view illustrating internal airflow of a blower fan according to the present invention.

FIG. 3 shows an internal airflow state of a blower fan according to the present invention.

Referring to FIG. 3, arrows indicate streamlines of the air. From the drawing, it can be note that the streamlines at an air discharge side are gently formed. This shows that the airflow interference and the noise caused thereby are reduced.

Figure 4:
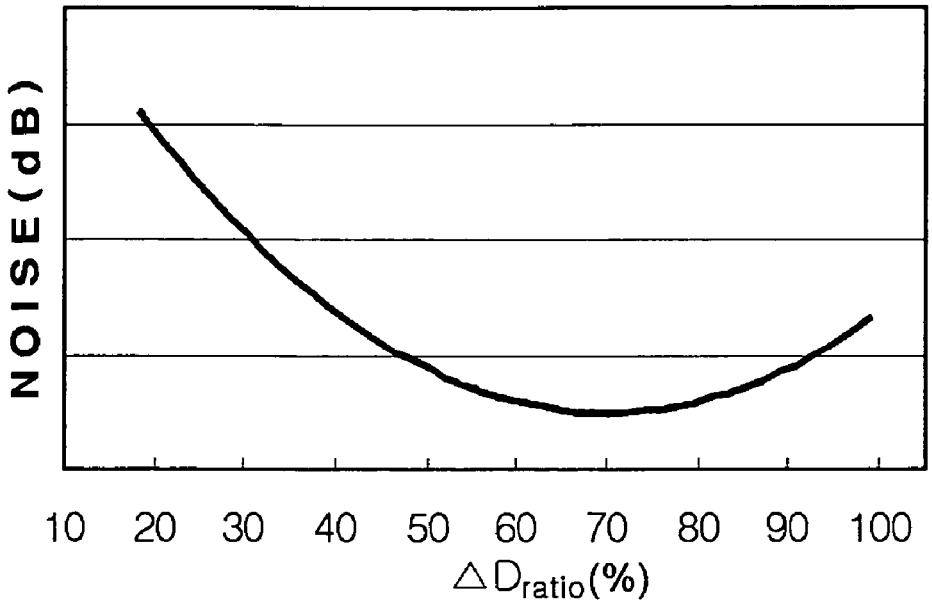
FIG. 4 is a graph illustrating a noise characteristic with respect to a variation of an outer diameter of each blade of a blower fan according to the present invention.

FIG. 4 shows a graph illustrating a noise characteristic with respect to the variation rate of the outer diameter of the blade of a blower fan according to the present invention.

As shown in the graph, the nose is lowest when the variation rate is about 72%. That is, it is noted that, when the variation rate is increased or decreased from the 72%, the noise is increased. Therefore, when the variation rate of the outer diameter of the blade 126 is set in a rage of 50–90%, it can be expected that the nose can be effectively alleviated. The variation rate can be adjusted by varying an outer diameter of a portion, which is close to the hub 124, of the blade 126 in a state where an outer diameter of a portion, which is close to the shroud 122, of the blade 126 is fixed to be identical to that of the shroud 122.

Figure 5:
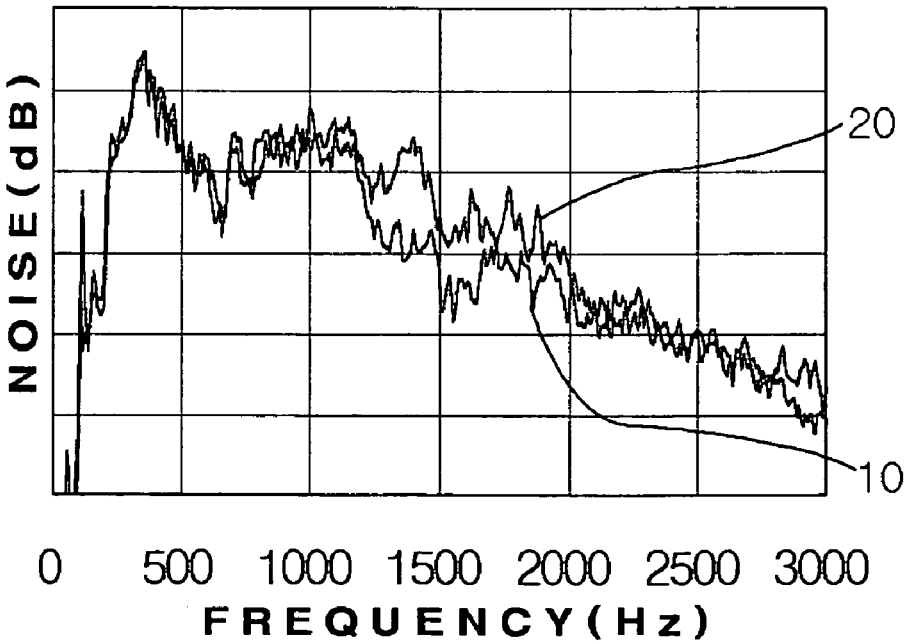
FIG. 5 is a graph illustrating a frequency range of airflow noise generated by a blower fan.

FIG. 5 shows a graph illustrating a frequency range of airflow noise generated by a blower fan.

In the graph, a curve 10 shows an amount of noise generated in a case where an end of each blade is vertically formed, and a curve 20 shows an amount of noise generate in a case where a variation rate of an outer diameter of the blade is 72%. As shown by the curves 10 and 20, the noise is alleviated in a frequency range of 1000–2000 Hz.

The blower fan can be applied to a wall mount air conditioner, an outdoor unit/indoor unit integrated air conditioner, or a ceiling embedded air conditioner to provide noise alleviation, reduction in power consumption, and increase in flow rate.

FIG. 6 shows a wall mount air conditioner where a flower fan of the present invention is applied.

Referring to FIG. 6, a wall mount air conditioner 100 includes a case 180 provided at a center with an intake hole 160, a blower fan 120 installed in the case 180 to forcedly generate air current into the case 180, a motor 150 for driving the blower fan 120, a bell mouth 130 for guiding airflow induced into the blower fan 120, and an evaporator 140 for generating cool air by heat-exchanging the indoor air, which is induced into the case by the blower fan 120, with a refrigerant, the cool air being discharged to the indoor side by the blower fan 120 through discharge holes 170 formed on upper and lower portions of the case 180.

The operation of the above-described wall mount air conditioner will be described hereinafter.

The refrigerant that is phase-changed into a liquid state is directed into the evaporator 140 and the indoor air is induced into the air conditioner 100 through the intake hole 160 by the blower fan 120. The indoor air introduced into the air conditioner is changed into the cool air by being heat-exchanged with the refrigerant flowing along the evaporator 140 and is then discharged to the indoor side through the discharge holes 170 formed on the case 180 by the blower fan 120. At this point, by the above-described inventive structure of the blower fan, the noise generating by the airflow can be remarkably reduced, thereby providing agreeable environment.

According to the present invention, by the optimized design of the blades, eddy current that may be caused by the flow interference between the hub and the ends of the blades can be suppressed, while the airflow noise and the power consumption rate can be reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A blower fan comprising:

a shroud;

a hub that guides airflow being discharged; and a plurality of blades disposed between the shroud and the hub, wherein an outer diameter of a first portion of the blade, which is close to the hub, is different from an outer diameter of a second portion of the blade, which is close to the shroud, to forcedly blow air through rotation of the blades, wherein a diameter of a portion of the blade, which abuts the hub, is greater than a diameter of the hub; and wherein the blades extend up to a central elevated portion of the hub.

2. The blower fan according to claim 1, wherein the outer diameter of the blade, which abuts the shroud, is identical to a diameter of the shroud.

3. The blower fan according to claim 1, wherein the outer circumference of the blade is reduced as it extends from the shroud to the hub.

4. The blower fan according to claim 1, wherein, when the first outer diameter is D1, the second outer diameter is D2 and an outer diameter of the hub is D0, $0.5<(D2-D0)<0.9$ is satisfied.

5. The blower fan according to claim 1, wherein an outer end of the blade is smoothly curved.

6. The blower fan according to claim 1, wherein an outer end of the blade is inclined inward as the blade extends from a shroud side to a hub side.

7. The blower fan according to claim 1, wherein an outer end of the blade is linearly formed.

8. The blower fan according to claim 1, wherein the blower fan is a turbo fan.

9. The blower fan according to claim 1, further comprising a bell mouth formed on a front surface of the shroud to guide airflow.

10. The blower fan according to claim 1, wherein a profile of the shroud is perpendicular to a rotation axis of the blower fan.

11. The blower fan according to claim 1, wherein an outer periphery of the hub is substantially parallel to the shroud.

12. A blower fan comprising:

a shroud;

a hub disposed facing the shroud at a predetermined distance from the shroud; and a plurality of blades disposed between the shroud and the hub, wherein, when an outer diameter of a first portion of the blade, which is close to the hub, is D1, an outer diameter of a second portion of the blade, which is close to the shroud, is D2, and an outer diameter of the hub is D0, $0.5<(D2-D1)(D2-D0)<0.9$ is satisfied, and wherein D1 is greater than D0.

13. The blower fan according to claim 12, wherein a diameter of a portion of the blade, which abuts the shroud, is identical to a diameter of the shroud.

14. The blower fan according to claim 12, wherein a center of the hub is elevated.

15. The blower fan according to claim 12, wherein an outer end of the blade is linearly formed.

16. The blower fan according to claim 12, wherein the blades extend to an elevated central portion of the hub.

17. The blower fan according to claim 12, wherein a width of the blade is reduced as it extends to a center of the blower fan.

18. A blower fan comprising:

a shroud positioned on an air intake side;

a hub positioned on an air discharge side to guide airflow being discharged; and a plurality of blades disposed between the shroud and the hub, wherein an outer end of each of the blades is inclined as the outer end extends from a shroud side to a hub side, to reduce airflow noise, wherein a diameter of a portion of the blade, which abuts the hub, is greater than a diameter of the hub; and wherein the blades extend to a central elevated portion of the hub.

19. The blower fan according to claim 18, wherein the outer end of each of the blades is inclined toward a center of the blower fan as each blade extends from a shroud side to a hub side.

20. The blower fan according to claim 18, wherein a length of each of the blades is greater than a half of radius of the hub.

21. The blower fan according to claim 18, wherein a profile of the shroud is perpendicular to a rotational axis of the blower fan.

22. The blower fan according to claim 18, wherein an outer periphery of the hub is substantially parallel to the shroud.

* * * * *

UNITED STATES PATENT AND TRADEMARK OFFICE

CERTIFICATE OF CORRECTION

PATENT NO. : 7,214,033 B2
APPLICATION NO. : 10/943007
DATED : May 8, 2007
INVENTOR(S) : Jung Woo Lee It is certified that error appears in the above-identified patent and that said Letters Patent is hereby corrected as shown below:

At column 5, line 55 of the printed patent, "0.5<(D2-D0)<0.9" should be --0.5<(D2-D1)/(D2-D0)<0.9--

Signed and Sealed this

Twenty-seventh Day of May, 2008

JON W. DUDAS
*Director of the United States Patent and Trademark Office*